United States Patent [19]

Ma et al.

[11] 3,942,758

[45] Mar. 9, 1976

[54] DAMPER VALVE

[75] Inventors: James Ju Luan Ma, Hacienda Heights; Yaacov Goland, Culver City, both of Calif.

[73] Assignee: Joy Manufacturing Company, Pittsburgh, Pa.

[22] Filed: Oct. 9, 1974

[21] Appl. No.: 513,458

[52] U.S. Cl. ..... 251/85

[51] Int. Cl.[2] ..... F16K 25/00

[58] Field of Search ..... 251/85; 137/309

[56] References Cited

UNITED STATES PATENTS

| | | | |
|---|---|---|---|
| 777,509 | 12/1904 | Huber | 137/309 |
| 1,114,978 | 10/1914 | Gamble | 251/85 X |
| 1,435,361 | 11/1922 | Wilputte | 137/309 X |
| 2,639,884 | 5/1953 | Mitchell | 251/85 |
| 3,198,478 | 8/1965 | Johnston | 251/85 |

*Primary Examiner*—Henry T. Klinksiek

[57] ABSTRACT

A gas conveying means and more particularly a gas conveying means such as a flue or duct having an improved damper valve and improved operating means therefor.

7 Claims, 2 Drawing Figures

DAMPER VALVE

It has long been well known to provide damper valves for regulating gas flow within flues, ducts and other such gas flow conveying means. For example, in many power generating plants wherein steam driven turbine generators receive driving steam from a boiler fired by fossil fuels such as coal or oil, the waste gases resulting from fuel combustion are conveyed from the boiler firebox by a flue including dampers which are provided to regulate the flow of combustion gases. Specifically, dampers have been employed for such varied purposes as, for example: selectively directing flue gas flow from one or more boiler fireboxes to one or more gas cleansing means such as a precipitator or scrubber; proportioning gas flow among a plurality of gas cleansing means: selectively varying gas pressure to regulate the flue draft; and the like.

Although prior damper valves employed for the abovementioned and other functions have generally served the purposes intended, they have nonetheless been subject to certain undesirable deficiencies. For example, seating surfaces of certain well known damper valves such as guillotine dampers have commonly been subject to fouling by accumulation thereon of fly ash or other particulate impurities entrained in the flue gas stream and such accumulations have often impeded gas tight closing of the valve. Additionally, the various possible settings of guillotine dampers, butterfly dampers and the like between the fully open and fully closed positions may dictate differing gas flow patterns therepast, some of which flow patterns may be undesirable, for example if they promote unwanted turbulence in the flowing gases to the detriment of subsequent operations such as gas cleansing or cooling.

The present invention provides a domed damper valve means which is operable by means of an improved axial push rod actuator whereby deficiencies of prior dampers such as cited hereinabove are overcome. Specifically, the damper of the present invention is not subject to fly ash fouling and is operable in a manner such that the flow pattern of gas flowing therepast remains substantially the same for any position of the valve, except the fully closed position of course whereat gas flow ceases completely. the damper of the present invention further provides improved actuator mechanism reliability and life span by having the actuating mechanism thereof isolated from the flue gas flow and thereby protected from deleterious particulate accumulations, corrosion and erosion.

Figure 1:
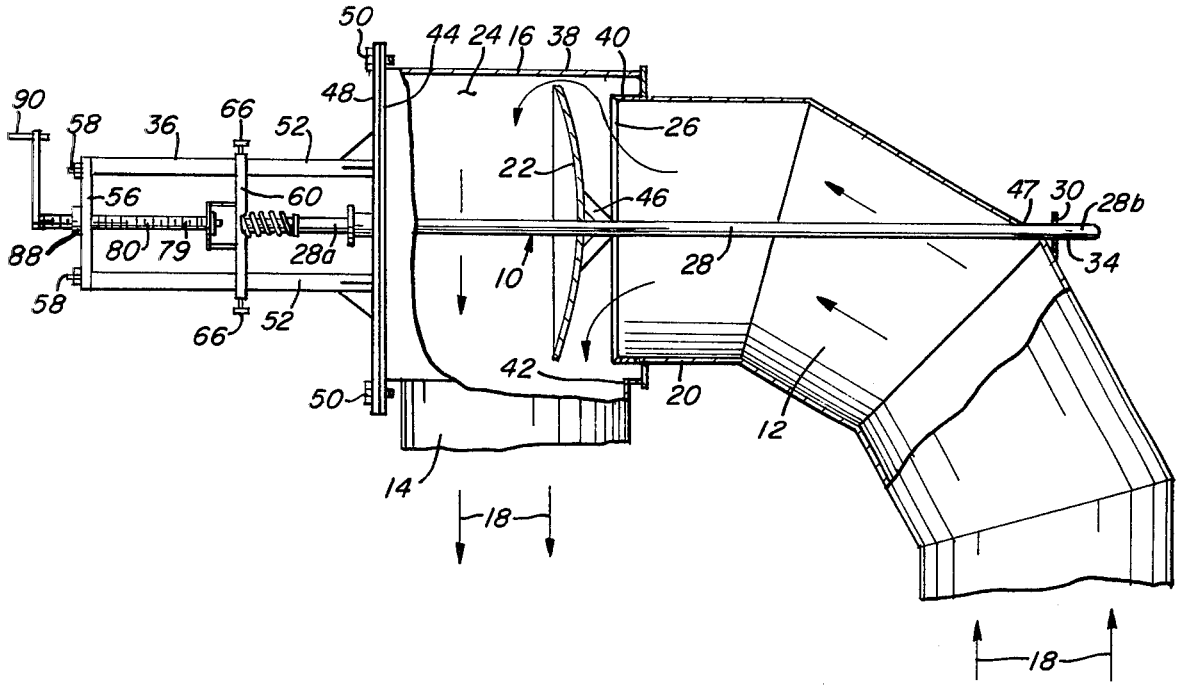
Figure 2:
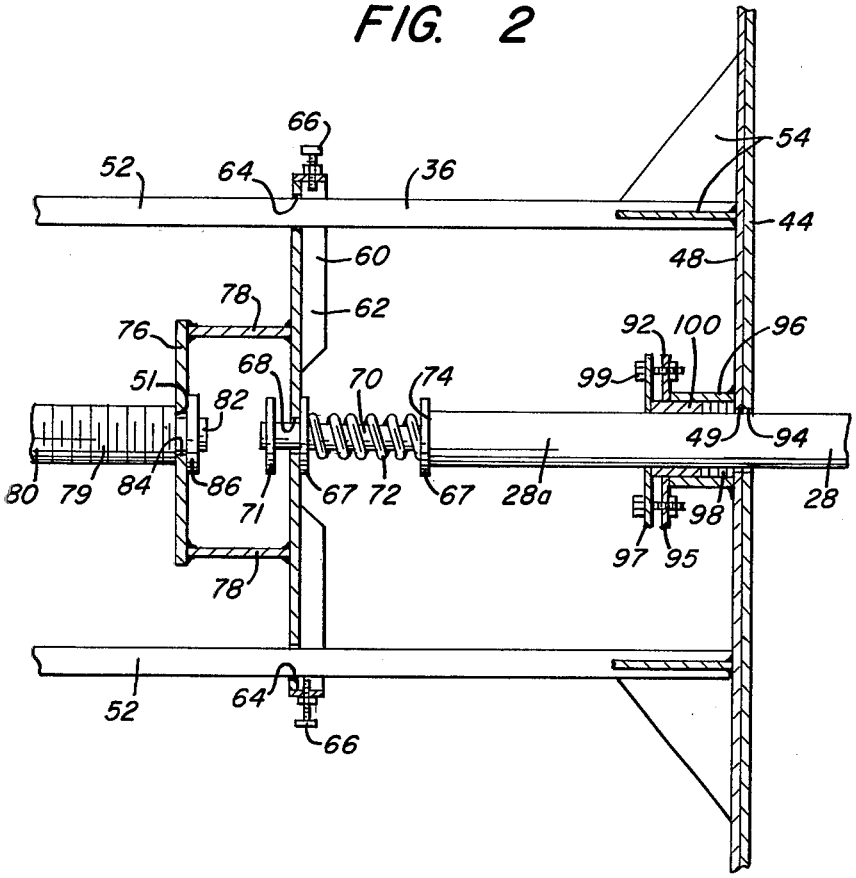

These and other objects and advantages of the present invention are more fully specified in the following description and illustrations, in which:

FIG. 1 is a partial longitudinal section of a gas flue including damper valve means of the present invention; and FIG. 2 is an enlarged fragmentary portion of FIG. 1 illustrating partly in section the operating mechanism of the valve of this invention.

There is generally indicated at 10 in FIG. 1 a damper valve assembly constructed in accordance with the principles of the present invention and adapted to selectively regulate gas flow within a gas conveying means shown as a flue 20. Those versed in the art will readily appreciate that in practice the damper 10 may be variously adapted to control or regulate gas flow within any known gas flow conduit, duct or other such gas conveying means. However, for purposes of simplified illustration the recitation hereinbelow is directed to the damper 10 as adapted for selectively opening or closing the flue 20 to gas flow therethrough. Of course it is to be understood from the outset that such simplification is not intended to unduly limit the scope of the invention described.

Flue 20 comprises an upstream flue portion 12 shown as being of a generally curved or elbow configuration and of a circular cross section, a downstream flue portion 14 likewise shown as having a generally circular cross section, and a generally rectangular intermediate flue portion 16 which communicates intermediate the portions 12 and 14 and carries the valve assembly 10 whereby the flue 20 is adapted to have a flow of gas directed therethrough in the direction indicated by arrows 18, for example the combustion gases from a coal or oil fired boiler (not shown( which communicates with flue portion 12. The flue gases so received into portion 12 are directed therethrough and further through the portions 16 and 14 in that order to a stack or gas processing means (not shown), for example a well known electrostatic precipitator or wet scrubber which communicates with flue portion 14.

As shown, the portion 16 is comprised of a generally rectangular housing 38 having an internal space 24 which communicates with the interior space of portion 12 by means of a port 40, and which further communicates with the interior space of portion 14 by means of a port 42 to provide for the conveying of gas therethrough intermediate portions 12 and 14 in the manner hereinabove described. Such gas flow is controllable by means of the valve 10, portions of which are housed within space 24 and are cooperable with port 40 to selectively open or close the port 40 to gas flow therethrough.

More particularly, the valve 10 as shown comprises: an axially movable, rigid actuator rod 28 extending through the space 24, coaxially through the port 40 and into portion 12; a valve controlling or actuator assembly 36 rigidly carried by the portion 16 in coaxial alignment with the rod 28 externally of housing 38 and adapted to render rod 28 axially positionable with respect to the housing 38; and a domed or dished valve head 22 suitably rigidly affixed coaxially with respect to rod 28 within space 24 as by means of gussets 46 rigidly secured to and extending between the rod 28 and the head 22.

Rod 28 includes respective axially opposed end portions **28*a* and 28*b* which extend externally of the flue 10, the portion 28*a* extending through a suitably sized bore 94 (FIG. 2) is a sidewall 44 of portion 16 opposite the port 40, and the portion 28*b* extending through a suitable bore 47 in the wall of portion 12. As shown the rod 28 is supported for axial movement thereof adjacent end portion 28*a* and outwardly adjacent bore 94 by means of the assembly 36 in a manner to be described hereinbelow. The portion 28*b* is shown as being supported outwardly adjacent bore 47 by means of a bearing bracket 30 rigidly carried adjacent the exterior of portion 12 and having a bore 34 to receive the rod end 28*b* whereby the valve head 22 carried by rod 28 is supported within space 24 for axial movement thereof with respect to port 40 to open or close the flue 20 in response to actuation thereof by assembly 36.**

As shown in FIGS. 1 and 2, assembly 36 comprises: a flat mounting plate 48 disposed outwardly adjacent wall 44 and rigidly affixed thereto as by means of screws 50 (FIG. 1); a pair of laterally spaced guide bars 52 suitably rigidly affixed to plate 48 and extending outwardly therefrom; a transverse member 56 (FIG. 1) which spans the space intermediate bars 52 adjacent the respective outermost ends thereof and is rigidly affixed thereto as by means of threaded fasteners 58; a transverse frame 60 carried by bars 52 and slideable longitudinally with respect thereto; and an elongated screw assembly 79 carried by member 56 and cooperable with frame 60 to render the frame 60 selectively positionable intermediate the ends of guides 52. As shown, the bars 52 are disposed in parallel relation to the axis of rod 28 and are spaced transversely in opposite directions therefrom. Bars 52 may be supported in the position described by plate 48 in any suitable manner, for example by welding thereof to gussets 54 rigidly carried by plate 48. The assembly 36 additionally includes a rod support portion 92 which is coaxially aligned with bore 94. The portion 92 includes a cylindrical bearing body 96 rigidly affixed adjacent the outer side of plate 48 and coaxially adjacent a bore 49 therein which is, in turn, disposed coaxially outwardly adjacent the bore 94. Body 96 is adapted to receive annular bearings 98 which encompass and support the rod 28 extending therethrough. The bearings 98 are captively retained within body 96 axially intermediate plate 48 and a cylindrical sleeve 100 disposed radially intermediate the body 96 and rod 28 and secured by screws 99 affixing together respective adjacent radially outwardly extending flanges 97 and 95 of sleeve 100 and body 96.

The frame 60 comprises a generally channel-shaped transverse member 62 having bores 64 laterally spaced to receive the respective bars 52, and a transverse member 76 rigidly carried by the member 62 and spaced outwardly therefrom as by rigid side plates 78 extending therebetween.

The member 76 receives a reduced diameter inner end portion 82 of the assembly 79 within an axial bore 84 of the member 76 and secures the portion 82 therewithin as by a washer 86 rigidly affixed adjacent the innermost end of the portion 82. Thus the assembly 79 captively retains the member 76 intermediate the washer 86 and a shoulder 51 spaced outwardly therefrom and located adjacent the intersection of portion 82 and a threaded portion 80 of assembly 79. Portion 80 extends axially outwardly from shoulder 51 through a cooperably threaded axial bore 88 (FIG. 1) in member 56 and has a crank handle 90 rigidly affixed adjacent the outermost end thereof.

Similarly, the rod end **28*a* has a reduced diameter end portion 70 which is secured within an axial bore 68 in member 62 by means of a washer 71 axially rigidly affixed adjacent the outermost end of the portion 70 to captively retain the member 62 intermediate the washer 71 and a helical spring element 72 which encompasses portion 70 axially intermediate member 62 and a shoulder 74 located adjacent the innermost end of portion 70. As shown, there may also be included intermediate member 62 and shoulder 74 washers 67 adjacent opposed ends of spring 72 to provide bearing surfaces for compression of the spring 72** during valve operation.

It will be apparent from the recitation hereinabove that in practice operation of valve 10 entails turning the crank 90 to advance screw 80 inwardly or outwardly thereby translating frame 60 inwardly or outwardly along guides 52 as desired. Responsive to the movement of frame 60, rod 28 is simultaneously translated axially inwardly or outwardly to adjust the flow area intermediate head 22 and an annular seating portion 26 of port 40. At one extreme position of valve 10 comprising a fully open state, head 22 is spaced axially outwardly from seat 26 sufficiently to provide substantially free flow of gas through the port 40. At the opposite extreme or fully closed position of valve 10, an annular portion of the convex side of head 22 contacts seat 26 to provide a gas tight sealing closure of port 40 against gas flow therethrough. By operation of the actuator assembly 36 as described hereinabove the valve 10 may be positioned at any point intermediate the fully opened and fully closed positions thereof to selectively control gas flow through the port 40.

It is to be noted that in closing the valve 10, the closing force imparted by assembly 79 is transmitted from frame 60 to rod 28 via spring 72 whereby additional turning of crank 90 after contact of head 22 with seat 26 merely translates frame 60 inwardly against the bias of spring 72 to compress the spring 72 thereby imparting a closing bias at the rate of, for example, approximately 150 pounds per inch of spring compression to maintain the valve 10 in the positively closed state. Such closing bias additionally provides a safeguard whereby excessive closing turns of crank 90 will not result in bending or other mechanical damage to head 22, seat 26 or other members inasmuch as the lost motion connection between assembly 79 and rod 28 is taken up in compression of the spring 72 rather than through mechanical deformation of other valve elements.

By virtue of the invention described hereinabove there is provided an improved damper valve incorporating improvements in operating mechanism and valve seating structures, and additionally providing safeguards against inadvertent damage through excessive tightening of the valve actuator during closing. The present invention furthermore provides for improved operating mechanism life span and reliability by isolating the valve operating mechanism from the gas flow and thereby minimizing the effects of corrosion, erosion and particulate accumulations.

Notwithstanding the reference hereinabove to one particular preferred embodiment of the invention, it is to be understood that this invention may be practiced in numerous other embodiments with various modification thereto without departing from the broad spirit and scope thereof. For example: screw 80 may be replaced by a fluid operable cylinder, or may be automated as by inclusion of a driving motor; rod end **28*b* need not extend through the wall of flue portion 12 for support but may alternatively be carried by support means within flue portion 12; member 62 may include locking devices, as for example lock screws 66 adapted to engage guides 52 to lock the valve 10 in a selected position thereof; spring 72 may alternatively be an elastomer, such as an elongated rubber cylinder; it is contemplated that head 22 may be domed on both sides thereof and adapted thereby to alternately open and close axially opposed ports, and rod end 70** may in such a case include spring bias elements for biased closing of both such ports; and the like.

These and other embodiments and modifications having been envisioned and anticipated it is requested that this invention be interpreted broadly and limited only by the scope of the claims appended hereto.

What is claimed is:

1. A valve assembly comprising: a valve member movable to selectively open and close a conduit and being carried by an elongated valve stem; an actuating assembly adapted to selectively control the movement of said valve member and including, a plurality of elongated guide means extending parallel to said valve stem, a movable transverse member extending between said guide means and slidable therealong, an actuating rod means communicating with said movable transverse member for selective positioning of said movable transverse member along said guide means, and biasing means communicating between said valve stem and said movable transverse member for biasing said valve member toward the closed position thereof and for providing a lost motion connection between said first transverse member and said valve stem after said valve member initially makes contact with such conduit.

2. A valve assembly as specified in claim 1 additionally comprising: a fixed transverse member extending between said guide means and being fixed thereto; said fixed transverse member including an internally threaded bore therethrough for threaded engagement with an externally threaded portion of said actuating rod means; wherein rotation of said actuating rod means causes said rod means along with said first transverse member to move in a direction parallel to said guide means.

3. A valve assembly as specified in claim 1 additionally comprising: locking means on said movable transverse member for selectively engaging said guide means to temporarily prevent movement between said movable transverse member and said guide means.

4. A valve assembly as specified in claim 1 wherein the surface of said valve member adapted to close such conduit is dished in a convex direction.

5. A valve assembly as specified in claim 1 wherein said guide means comprise two bars rigidly affixed exteriorally of such conduit.

6. A valve assembly as specified in claim 1 wherein said biasing means comprises a compression spring carried by one end portion of said valve stem.

7. A valve assembly as specified in claim 6 wherein said valve stem extends on both sides of said valve member and the end portion of said valve stem opposite said one end portion is adapted to be slidingly supported by such conduit.

* * * * *